United States Patent [19]

Rosauer

[11] 3,939,355

[45] Feb. 17, 1976

[54] AUTOMATIC LOCKING RADIOISOTOPE CAMERA LOCK

[75] Inventor: Peter J. Rosauer, Mount Prospect, Ill.

[73] Assignee: Magnaflux Corporation, Chicago, Ill.

[22] Filed: Oct. 4, 1974

[21] Appl. No.: 512,063

[52] U.S. Cl. ..... 250/497; 250/493

[51] Int. Cl.[2] ..... G21F 5/02

[58] Field of Search ..... 250/497, 493

[56] References Cited

UNITED STATES PATENTS

| | | | |
|---|---|---|---|
| 2,891,168 | 6/1959 | Goertz et al. | 250/497 |
| 3,393,317 | 7/1968 | Spencer | 250/497 |

*Primary Examiner*—Harold A. Dixon

*Attorney, Agent, or Firm*—Hill, Gross, Simpson, Van Santen, Steadman, Chiara & Simpson

[57] ABSTRACT

Radioisotope camera lock, locking the source isotope in a safe, shielded position in the camera when not in use. The lock prevents the source isotope from being moved to an operative position outside of the camera, unless intentionally released by a key and reverse movement of source pigtail. A hollow lock casing is secured to and has communication with the interior of the radioisotope camera. The source isotope is at the end of a source pigtail and is cranked or pushed from the camera and pulled back into the camera by the cranking mechanism. A stop on the source pigtail cooperates with a lock spool movably mounted in the lock casing. A lock lever pivoted in the lock casing is provided to hold the source isotope in a shielded condition within the camera upon moving the lock to its locked condition. The locking arrangement is such that the source isotope will automatically be trapped in the camera as fully withdrawn into the camera prior to manual locking. The source isotope also cannot be removed from the camera after the key and key cylinder are moved to a release position until a pulling action is applied to the source pigtail and stop by the conventional cranking mechanism.

14 Claims, 7 Drawing Figures

AUTOMATIC LOCKING RADIOISOTOPE CAMERA LOCK

BACKGROUND, SUMMARY AND ADVANTAGES OF INVENTION

Heretofore radioisotope sources have been locked in a shielded condition in a camera and have been released to accommodate the isotope source to be extended from the camera for use. With such locks, the isotope source may be completely removed from the camera when the lock is released and there is no indication whether the source is released or locked in the camera. The prior locks do not automatically lock the source in the camera when retracted and cannot prevent complete removal of the isotope source when the lock is released without an additional overt act, and thereby do not prevent exposure of the operator of the camera to dangerous rays, if the operator or others should mistakenly release the lock by its key.

The lock of the present invention secures the isotope source in a stored shielded condition in the camera until a positive effort has been made to open the lock and take the source outside of the camera and prevents disconnection of the source pigtail unless the source is locked in a shielded condition in the camera. It also gives a visual indication of the locked or possible exposed condition of the isotope source and prevents the source pigtail from being completely pushed out of the camera, even when the lock is released.

An advantage of the invention, therefore, is that a visual indication is given when the isotope source is in an exposed condition.

A further advantage is that the isotope source is automatically locked in the camera as cranked into the camera, thereby providing the operator with a physical assurance that the source is in a safe condition.

Another important advantage of the invention is that the isotope source is trapped in a shielded condition in the camera until the lock is release-activated by turning of the key for the lock and a further intentional pulling action on the source pigtail is exerted to complete the unlocking operation.

A further advantage of the invention is that the source cannot be pulled through the camera or be disconnected until the source has been pulled to the automatic lock position.

A still further advantage of the invention is the provision of a lock barrel depressed within the lock casing to effect locking of the lock, and extended from the lock casing when in a released position, and requiring pulling on the source pigtail to fully release the lock prior to pushing the source from the camera for use.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

DESCRIPTION OF PREFERRED EMBODIMENT OF INVENTION

Figure 1:
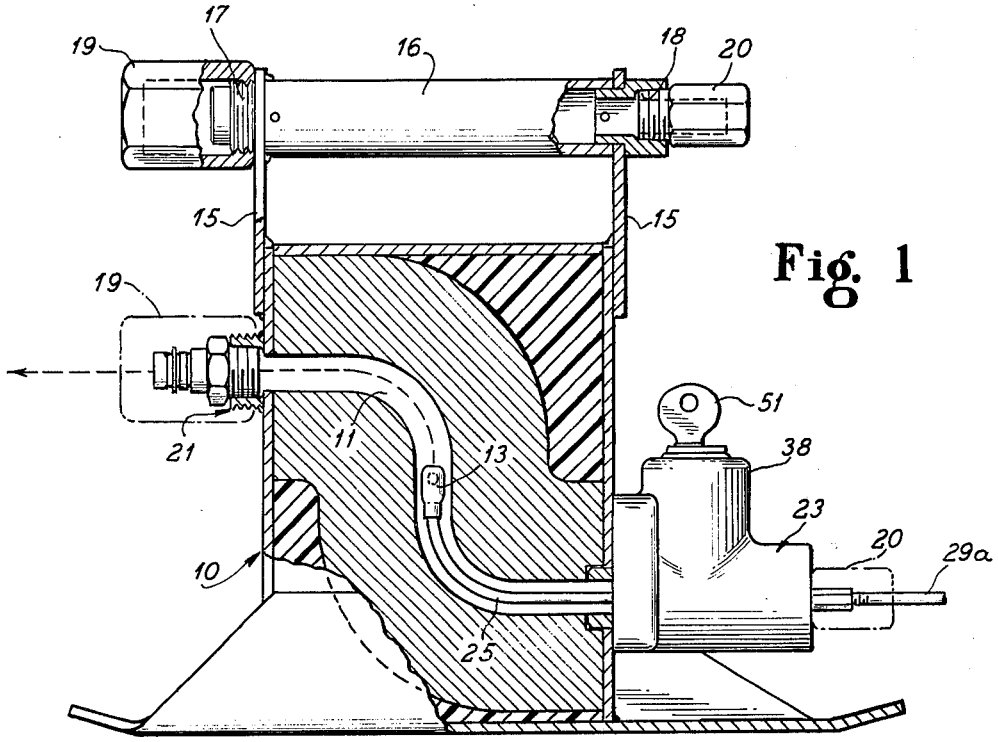
FIG. 1 is a sectional view taken through a radioisotope camera showing the radioisotope in a shielded condition in the camera.

In FIG. 1 of the drawings, I have illustrated a radioisotope camera 10 forming an isotope shield and having an S-shaped shielded passageway 11 extending from the front to the back of the camera and shielding a radioisotope source 13 in the camera when not in use. The camera is of a form generally well-known to those skilled in the art, and has bracket plates 15,15 at opposite ends of the camera extending above the camera proper and forming a support for a handle 16. The handle has an externally threaded coupling 17 at one end and an internally threaded coupling 18 at its opposite end for respectively detachably holding a safety plug 19 and a safety cap 20. The safety plug 19 is adapted to be threaded on a coupling 21 in communication with the exit end of the shielded passageway 11. The safety cap 20 is adapted to be threaded within the enlarged diameter end of a passageway 22 (FIG. 2) leading into a lock casing 23 in axial alignment with the locked end of the shielded passageway 11, as indicated by broken lines in FIG. 1. The handle 16 thus provides a convenient means for carrying the safety plug 19 and safety cap 20 to be attached to the camera and the lock casing 23, respectively, when the radioisotope source is not in use, as well as a carrying means for the camera.

The source 13 is suitably coupled to the end of a flexible pigtail 25, shown as being in the form of a tube and extending along the shielded passageway 11 and through and to the outside of the lock casing 23. The pigtail 25 has a truncated ball 27 (FIG. 2) connected thereto intermediate its ends, forming a stop for the pigtail and accommodating turning of the pigtail to position a coupling 29 on the end of the pigtail in a convenient position to be coupled to its drive cable **29*a* to extend and retract the isotope source from or within the shielded passageway 11.** The isotope source and pigtail are extensibly and retractably moved by a conventional cranking mechanism which is no part of the present invention, so need not herein be shown or described.

The source pigtail 25 and truncated ball 27 extend along a hollow interior lock chamber 30 of a lock spool 31 movably mounted in the hollow interior portion of the lock casing 23. The lock spool 31 has an interior shouldered portion 32 forming a stop for the truncated ball 27 and pigtail 25. A cooperating stop lever 33 is bifurcated at each end and is pivoted to a transverse pivot shaft 34 for movement about an axis transverse to axial movement of the pigtail and truncated ball 27. The stop lever 33 extends through a slotted portion 35 of the lock spool into the hollow interior portion thereof and has spaced abutment surfaces 36. The abutment surfaces 36 form locking surfaces for the truncated ball 27, to hold said ball 27 in its locked position in the lock casing 23. The pivot shaft 34 is spaced from the end plate 15 of the camera shield by spaced brackets 37 extending from the end plate 15 into the hollow interior of the lock casing. A torsion spring 39 encircles the pivot pin 34 and abuts an interior wall 28 of the lock casing 23 and an abutment wall 40 between the furcations of the stop lever 33 to bias the stop lever in a clockwise direction into the locked position shown in FIG. 2. As shown in the drawings, the lock spool 31 has a keyway 41 in its bottom surface for dirt passage during compressed air cleaning operations, the compressed air exiting through the passageway 22. The lock spool 31 also has a plurality of sockets 43 therein for springs 44 biasing said stop spool towards the end plate 15.

The lock casing 23 has a right-angled hollow boss 38 in communication with the interior of the lock casing. The hollow interior portion of the boss 38 forms a chamber for a lock barrel 45. The lock barrel 45 is slidably carried in an outwardly opening shell 46 retained to the hollow interior portion of the boss 38 as by a set screw 47. The lock barrel 45 is slidably guided for rectilinear extensible movement relative to the shell 46 by a pin 48, which may be a machine screw extending from the lock barrel and slidably guided along a slot 49 in the shell, to not only accommodate extensible and retractable movement of the lock barrel 45 along the shell, but also to retain the lock barrel to the shell.

The lock barrel 45 forms a barrel for a key cylinder 50 (partially shown) and turned by a key 51. The key cylinder contains the usual tumblers which are effective for withdrawing a pin 53 from an apertured portion 52 in the shell 46 to accommodate extension of said lock barrel relative to the shell 46 and to hold said lock barrel in an innermost retracted position relative to the shell. The key cylinder 50 is a conventional key cylinder carrying tumblers (not shown), effective to withdraw the pin 53 from the shell 46 by turning movement of the key 51. The lock barrel 45 is biased by a plurality of springs 54 to be extended from the shell 46 when the pin 53 is withdrawn from the shell 46. These springs are stronger than the torsion spring 39, to effect release of the lock upon withdrawal of the pin 53 from the apertured portion 52, as will hereinafter more clearly appear as this specification proceeds. The key 51 and key cylinder 50 form no part of the present invention, except to control the pin 53 to form a selective lock for locking the lock barrel in its retracted position, so need not be shown or described further.

The lock barrel 45 has a bifurcated hanger 59 extending downwardly therefrom into the hollow interior portion of the casing 23, when the lock is in its locked position. The hanger 59 forms a mounting for a pivot pin 60 for a lock hook 61. Said lock hook has a hook-like lower end and extends between the furcations of the stop lever 33. A torsion spring 63 turned about the pin 60 biases said lock hook in a direction shown in the drawings as a counterclockwise direction to engage a downwardly facing abutment portion 65 of a trip member 64.

The trip member 64 is carried by the stop lever 33, between the furcations thereof. Said trip member 64 also has an upwardly facing stop portion 66 on its side opposite from said abutment portion and adapted to engage under an abutment 67 in the locking spool 31. This holds the stop lever 33 from release, as the hook

Figure 2:
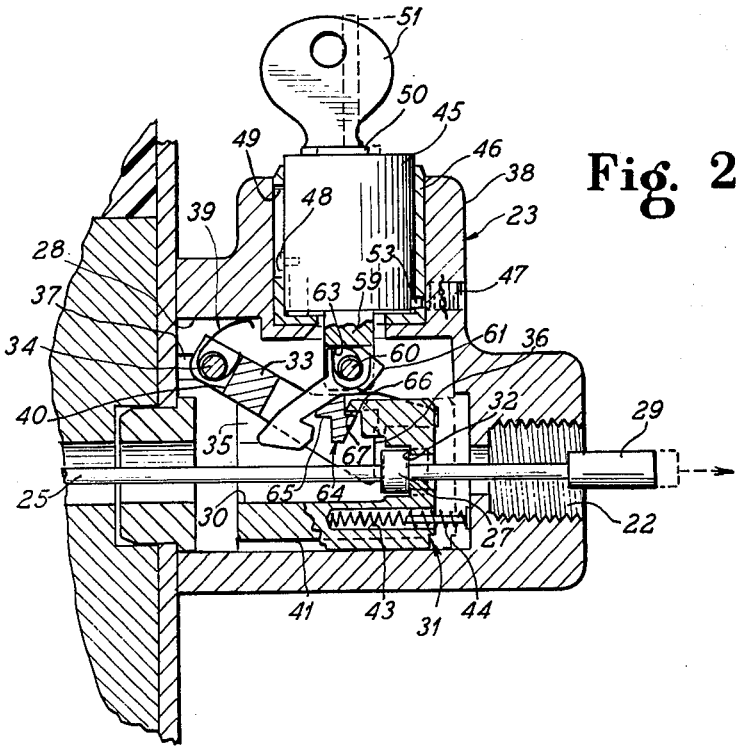
FIG. 2 is a longitudinal sectional view taken through the lock casing and showing the lock in a locked condition.
Figure 5:
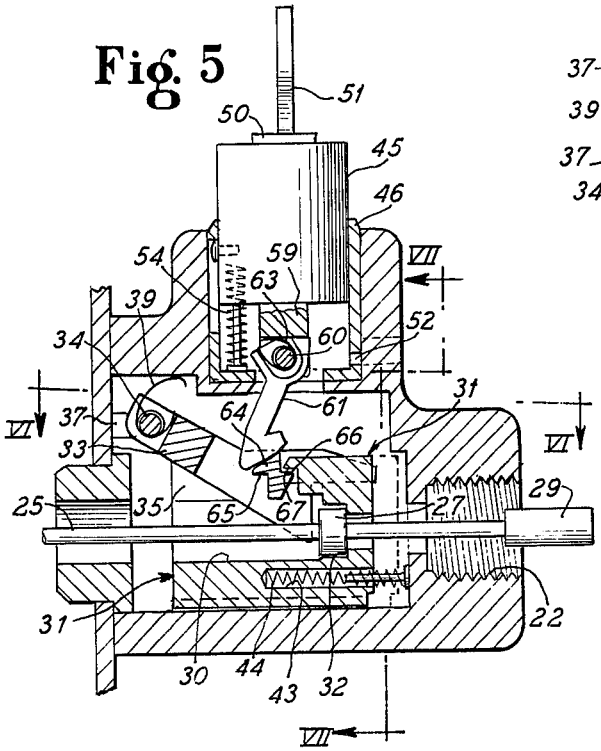
FIG. 5 is a longitudinal sectional view similar to FIG. 1, but showing the lock barrel extended with the pigtail fully retracted and in an automatically locked condition.
Figure 6:
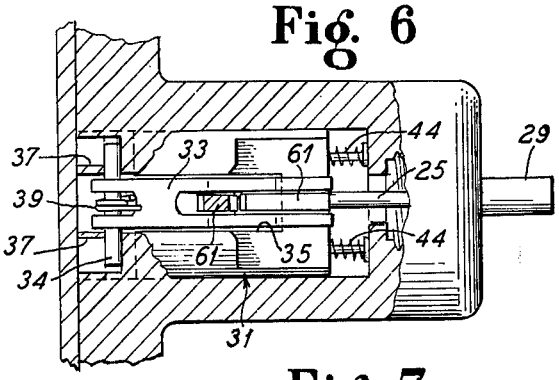
FIG. 6 is a sectional view taken substantially along lines VI—VI of FIG. 5.
Figure 7:
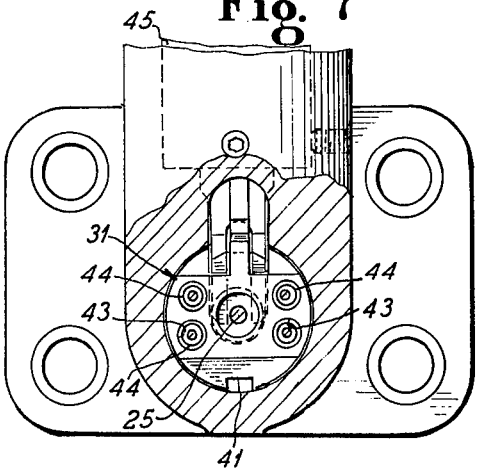
FIG. 7 is a sectional view taken substantially along lines VII—VII of FIG. 5.

61 engages beneath the abutment portion 65 of the stop lever 33, upon release of the barrel 45 by turning movement of the key 51, from the solid line position shown in FIG. 1 to the dotted line position shown in this figure and the solid line position shown in FIG. 5, until tension is placed on the coupling 29. Movement of the spool 31 in a direction which, in FIG. 2 is to the right, releases the stop portion 66 from the lock spool and accommodates the hook 61 to lift the stop lever 33 to its released position upon extensible movement of the lock barrel by the springs 54. It should be understood that the springs 54 are stronger than the torsion spring 39, to assure lifting of the lock lever out of registry with the lock spool upon extension of the lock barrel 45 relative to the shell 46.

To release the lock, the pin 53 is released from the aperture 52, by turning of the key 51 to the dotted line position shown in FIG. 2. The springs 54 (FIG. 3), are stronger than the spring 39, and will then lift the lock barrel 45 from the shell 46 and position the lock hook 61 to engage under the abutment portion 65. As tension is applied to the coupling 29 to release the stop portion 66 from the abutment 67 of the lock spool 31, the lock hook 61 will raise the stop lever 33.

The sequence of releasing the lock, therefore, is that as the key is turned to a release position, the lock barrel 45 will rise half of its total movement. The hook 61 will then engage the abutment portion 65, the stop portion 66 being restrained by the abutment 67 as the spring 54 pushes the lock barrel 45 upwards. Tension on the coupling 29 will then move the spool 31 to the right. This will allow the stop lever 33 to be raised by the hook 61 as springs 54 move the lock barrel 45 upward.

Figure 3:
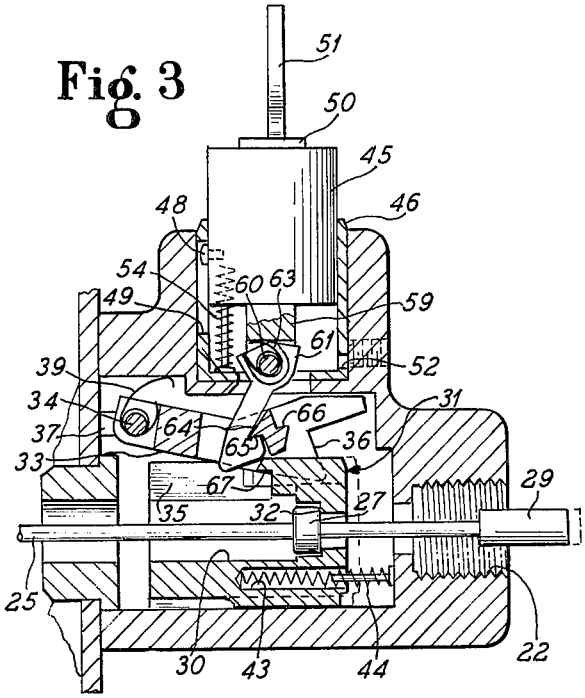
FIG. 3 is a longitudinal sectional view taken through the lock casing, showing the lock in a partially released position.
Figure 4:
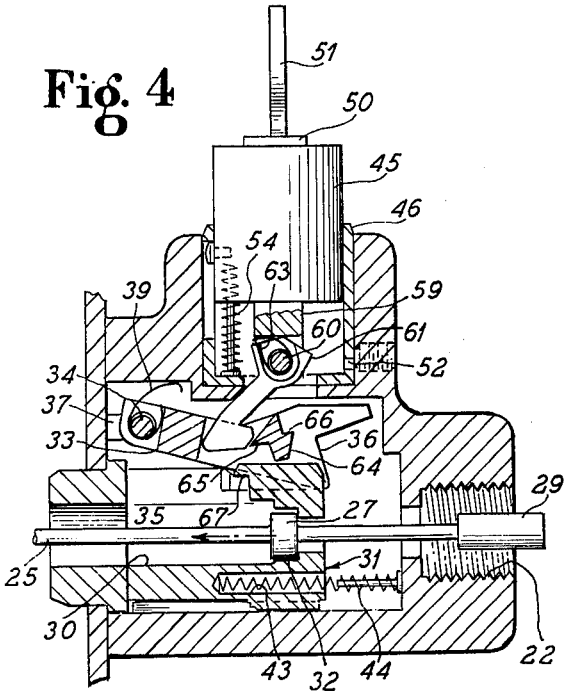
FIG. 4 is a longitudinal sectional view similar to FIGS. 1 and 2, but illustrating the lock in a fully released position.

It may be seen from FIGS. 3 and 4 that as the lock barrel is extended relative to its shell and lifts the stop lever 33 into the position shown in FIG. 3, the spring 44 biasing the lock spool 31 toward the end plate 15 of the camera, will move the lock spool 31 into the extreme position to the left, as shown in FIG. 4. Upon movement of the lock spool 31 from the position shown in FIG. 3 to the position shown in FIG. 4, the lock spool 31 will cam the lock hook 61 to release said lock hook from the trip member 64 and accommodate the trip member 64 to rest on the top surface of the lock spool 31, as biased into engagement with said top surface by the torsion spring 39. The isotope source 13 and pigtail 25 may then be extended from the camera by cranking to a position of use.

The truncated stop ball 27, however, limits the amount of withdrawal of the isotope source and prevents complete withdrawal of the source pigtail 25 from being drawn to the right through the lock casing and camera.

It should further be understood from FIG. 5 that the isotope source is withdrawn in the camera shield and the truncated stop ball 27 comes into engagement with the interior shouldered portion of the stop spool 31 and moves said spool 31 against the bias of the spring 44 from the position shown in FIG. 4 to the position shown in FIG. 5, that the stop lever 33 will be released from the spool and the torsion spring 39 will move the stop lever 33 into position to place the abutment surfaces 36 thereof to stop movement of the stop ball 27 toward the camera. The isotope source thereby is automatically locked in the camera, even though the lock barrel is extended. This acts as a safeguard to prevent unintentional release of the isotope source from the camera shield when once withdrawn.

As, however, the lock spool 31 is moved to the right by reverse cranking of the source pigtail, the stop portion 66 of the trip member 64 will be released from the abutment 67. The torsion spring 63, biasing the lock hook 61 against the upper inclined surface of the trip member 64, will hold the stop member in its locking position as biased in such a position by the torsion spring 39 until depression of the lock barrel and then the extension of said lock barrel by the springs 54.

It will further be understood from FIG. 4 that the barrel 45 cannot be depressed to a lock position while the ball 27 is in the position shown or extended from the camera. Depressing the barrel 45 moves the lock hook 61 through the stop lever 33 to rest on top of the spool 31. The hook cannot engage the abutment portion 65 at this position and the lock barrel 45 returns to its up position upon pressure release.

I claim as my invention:

1. In a lock assembly for securing an isotope source in a radioisotope camera shield, a pigtail extending from said source and adapted to extend and withdraw the isotope source relative to the camera shield, a hollow lock casing adapted to be secured to the radioisotope camera shield and having a longitudinal lock chamber opening to the camera shield, and a lock barrel chamber extending at right angles with respect to said lock casing, a stop on the source pigtail, a lock barrel in said barrel chamber, and biased in an extended position relative to said lock barrel chamber, a key cylinder in said lock barrel, means operable by turning movement of said key cylinder to hold said lock barrel in a retracted position relative to said chamber or release said lock barrel to be extended from said chamber, and three cooperating movable elements for locking and releasing said stop, two being operated by turning of the key cylinder and retracted or extended movement of the lock barrel and the third being operated by withdrawal tension on the pigtail and requiring an overt act on the pigtail in addition to turning of the key cylinder and release of the lock barrel to release the pigtail for extension outside of the camera shield for use.

2. The lock assembly of claim 1, wherein the first of said three cooperating movable elements includes a stop lever pivoted within said lock chamber and biased to engage said stop and retain the source pigtail within the camera, the second includes hook means pivoted to said lock barrel to depend therefrom into said longitudinal lock chamber and biased to engage and lift said stop lever out of the path of said stop on the source pigtail upon extended movement of the lock barrel with respect to the lock chamber, and the third includes a lock spool slidable along said lock chamber and biased toward the camera in locking position in the lock chamber and moved to release said stop lever by tension on the source pigtail and stop.

3. The lock assembly of claim 2, wherein the stop lever has a trip member thereon disposed intermediate the ends thereof and adapted to be engaged by said lock hook upon extensible movement of said lock barrel from said lock chamber and lift said stop lever out of the path of said stop on the source pigtail upon reverse movement of said lock spool away from the camera shield.

4. The lock assembly of claim 3, wherein spring means bias said lock hook to engage said trip member, second spring means bias said stop lever to engage said stop on said source pigtail, and wherein said trip member has an upper surface camming said lock hook to engage and lift said trip member and stop lever upon extension of said lock barrel relative to said lock barrel chamber.

5. The lock assembly of claim 4, wherein spring means stronger than the spring means biasing said lock lever to engage said truncated ball on the source pigtail, lift said lock barrel relative to said lock barrel chamber upon release of the lock barrel by the key and move said hook to engage said lock lever and move said lock lever upward to its upper limit of travel.

6. The lock assembly of claim 5, wherein said first and second springs are oppositely acting torsion springs and said third spring is at least one compression spring.

7. The lock assembly of claim 5, wherein the trip member is held from upward movement by said lock spool and released by reverse movement of said lock spool out of the path of said trip member.

8. The lock assembly of claim 7, wherein said trip member has a downwardly facing abutment surface adapted to be engaged by said lock hook and has an oppositely facing abutment surface adapted to be engaged by said lock spool to hold said stop lever in a locking position until reverse pull on said source pigtail removing said spool out of registry with said stop surface.

9. The lock assembly of claim 4, wherein said trip member has a downwardly facing abutment surface adapted to be engaged by said lock hook to lift said stop member upon extensible movement of said lock barrel, and has an oppositely facing abutment surface adapted to be engaged by said lock spool, and engaged by said lock spool by the bias of said lock spool toward said camera, to hold said stop lever in a locking position until reverse pull on the pigtail moving said lock spool out of registry with said oppositely facing surface of said trip member to release said trip member and lock lever and condition said lock lever to release said stop on said source pigtail upon a predetermined reverse pull on the source pigtail.

10. The lock assembly of claim 9, wherein the first and second spring means are oppositely acting torsion springs and at least one compression spring stronger than said torsion springs serves to extend said lock barrel upon release by the key cylinder.

11. The lock assembly of claim 10, wherein the barrel chamber has a shell therein forming a liner for said chamber and bearing for said lock barrel, wherein a guide connection is provided between said shell and lock barrel to guide said lock barrel for rectilinear movement relative to said shell, and wherein a pin and aperture lock is provided between said lock barrel and shell and retractable by turning movement of the key cylinder to a release position.

12. The lock assembly of claim 11, wherein stop means are provided engageable by said stop spool to prevent complete withdrawal of the source pigtail from the camera shield.

13. The lock assembly of claim 11, wherein the truncated ball is automatically trapped at the full retracted position of the pigtail and ball.

14. The lock assembly of claim 11, wherein means are provided to prevent depression of the barrel while the source pigtail is in exposed position.

* * * * *